US005083925A

United States Patent [19]

Maruyama

[11] Patent Number: 5,083,925

[45] Date of Patent: Jan. 28, 1992

[54] COPYING APPARATUS

[75] Inventor: Takashi Maruyama, Tokyo, Japan

[73] Assignees: Yonezawa Corporation; Kabushikikaisha Sunmak, both of Tokyo, Japan

[21] Appl. No.: 553,205

[22] Filed: Jul. 13, 1990

[30] Foreign Application Priority Data

Dec. 25, 1989 [JP] Japan ..... 1-332869

[51] Int. Cl.[5] ..... B41L 1/12

[52] U.S. Cl. ..... 434/410

[58] Field of Search ..... 434/410, 408, 412, 415, 434/429, 85

[56] References Cited

U.S. PATENT DOCUMENTS 2,451,979 10/1948 Rosenblum ..... 434/410
4,001,665 1/1977 Wisner et al. .
4,346,657 8/1982 Okutsu ..... 434/410 X

FOREIGN PATENT DOCUMENTS 53-21046 1/1978 Japan .
53-34510 1/1978 Japan .
54-121046 1/1979 Japan .
55-38662 1/1980 Japan .
56-25396 1/1981 Japan .
56-86185 1/1981 Japan .

*Primary Examiner*—Robert Bahr
*Assistant Examiner*—Karen A. Richard
*Attorney, Agent, or Firm*—Panitch Schwarze Jacobs & Nadel

[57] ABSTRACT

A copying apparatus is provided in which a transparent soft sheet is mounted to an upper face of an opaque sheet so as to be in contact with and out of contact with the opaque sheet. The copying apparatus comprises a closure frame, a box-like body having a smooth upper face, the closure frame being mounted to the box-like body in an openable and closeable manner, a carbon-paper press frame superimposed upon a rear face of the closure frame in an openable and closeable manner, and a pair of roller means mounted respectively to one side of the box-like body and to one side of the closure frame in facing relation to each other and a buzzer. The opaque sheet is made of a soft material and is stretched upon the closure frame. At least one of the pair of roller means is connected to a roller rotating unit and the buzzer and the roller rotating unit are connected to an electric power source through a switch.

13 Claims, 2 Drawing Sheets

COPYING APPARATUS

BACKGROUND OF THE INVENTION

1. Field of the Invention

The present invention relates to a copying apparatus for use chiefly as a toy.

2. Description of the Prior Art

The following copying apparatus for enterable and erasable letters or characters, pictures or the like has already been proposed in Japanese Patent Provisional Publication No. 25396/81. That is, the copying apparatus comprises an upper sheet and a base sheet. The upper sheet has resiliency or elasticity locally deformed elastically by an urging force due to a entering instrument. The upper sheet contains a homogeneous fluorescent pigment. The base sheet is located in the rear of the upper sheet and is capable of serving as a reflector for a light. The base sheet is made of an opaque body. When the upper sheet is in contact with the base sheet, the latter can maintain the close contact condition between the upper sheet and the base sheet.

However, the above copying apparatus is difficult to take an interest of children, because, when the upper sheet is torn off from the base sheet, the displayed characters or the like disappear. Thus, the copying apparatus does not totally resemble a real copy machine.

SUMMARY OF THE INVENTION

It is therefore an object of the invention to provide a copying apparatus in which it is possible to often and repeatedly practice entering and erasing with respect to a sheet, in which it is possible to copy letters or characters or patterns entered onto the sheet, onto a paper as they are, in which the paper is automatically fed out while emitting a sound, in which the copying apparatus resembles a true copy machine more than the copying apparatus described in the above background of the invention, and in which the copying apparatus of the invention is more rich in taste as a toy.

In order to achieve the above object, according to the invention, there is provided a copying apparatus in which a transparent soft sheet is provided on an upper face of an opaque sheet so as to be capable of being in contact with and out of contact with the latter, wherein a closure frame is mounted to a box-like body having a smooth upper face, in an openable and closable manner, wherein a carbon-paper press frame is superimposed upon a rear face of the closure frame in an openable and closable manner, wherein a pair of roller means facing toward each other are mounted respectively to one side of the box-like body and to one side of the closure frame, wherein a buzzer is provided, wherein the opaque sheet is made of a soft material and is stretched upon the closure frame, wherein at least one of the pair of roller means is connected to a roller rotating unit, and wherein the buzzer and the roller rotating unit are connected to an electric power source through a switch.

In the copying apparatus according to the invention, since the transparent soft sheet and the opaque sheet are superimposed upon each other so as to be capable of being in contact with and out of contact with each other, it is possible to often enter and erase the letters or characters or the pictures onto the sheet in a repeated manner. A carbon paper is superimposed upon the rear face of the closure frame in a detachable manner, whereby, if a paper is clamped between the closure frame and the box-like body, it is possible to copy the letters or characters or the pictures entered onto the sheet, onto the paper as they are.

Further, since the buzzer and the roller rotating unit are provided, the copying apparatus has its decency or style which resembles a copy machine. The paper is automatically discharged while the buzzer sound is emitted. Thus, the copying apparatus becomes more rich in taste as a toy.

DETAILED DESCRIPTION OF THE PREFERRED EMBODIMENT

Figure 1:
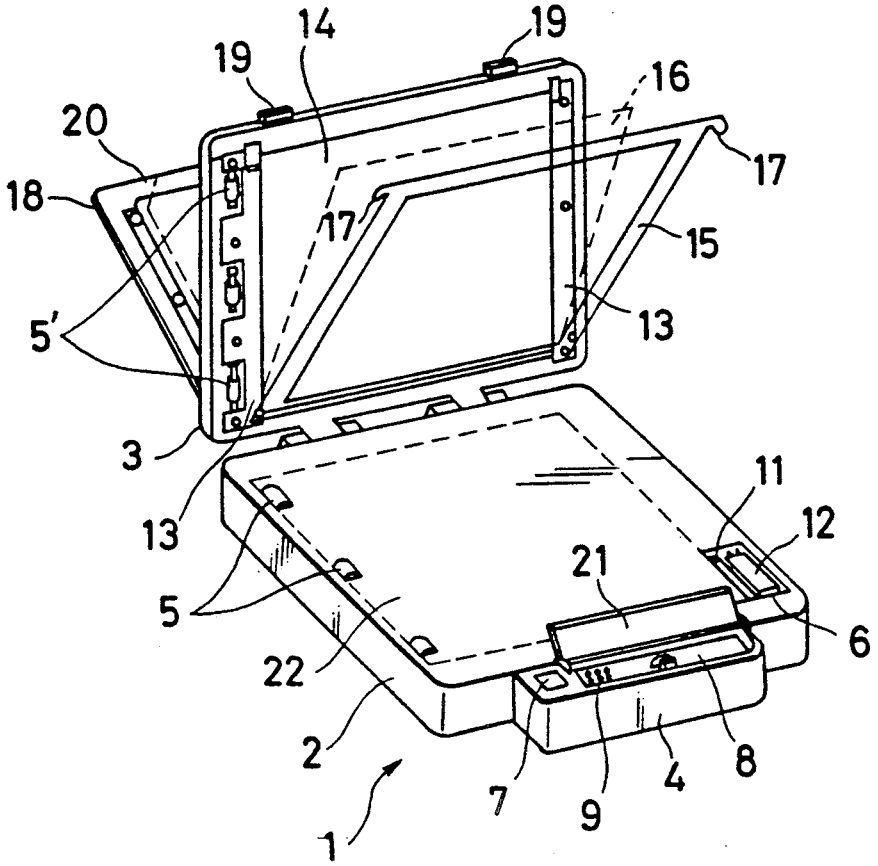
FIG. 1 is a perspective view of of a copying apparatus according to an embodiment of the invention, at the time a closure frame is moved to an open position.

Referring to FIG. 1, there is shown a copying apparatus 1 which comprises a box-like body 2 and a closure frame 3. The box-like body 2 is formed into a box configuration which has a smooth upper face and a hollow interior. The box-like body 2 has its front face which is integrally formed with a projection 4. A plurality of rollers 5 are rotatably supported at one side of the upper face of the box-like body 2. A cell accommodating recess 6 is formed at a section of the box-like body 2 adjacent the other side thereof.

The projection 4 is provided thereon with a switch 7, and formed therein with a entering-instrument accommodating recess 8. A buzzer 9 is incorporated in the projection 4 at a location below a bottom surface of one side of the entering-instrument accommodating recess 8. A closure plate 21 is provided for covering the entering-instrument accommodating recess 8 in an openable and closable manner.

Figure 2:
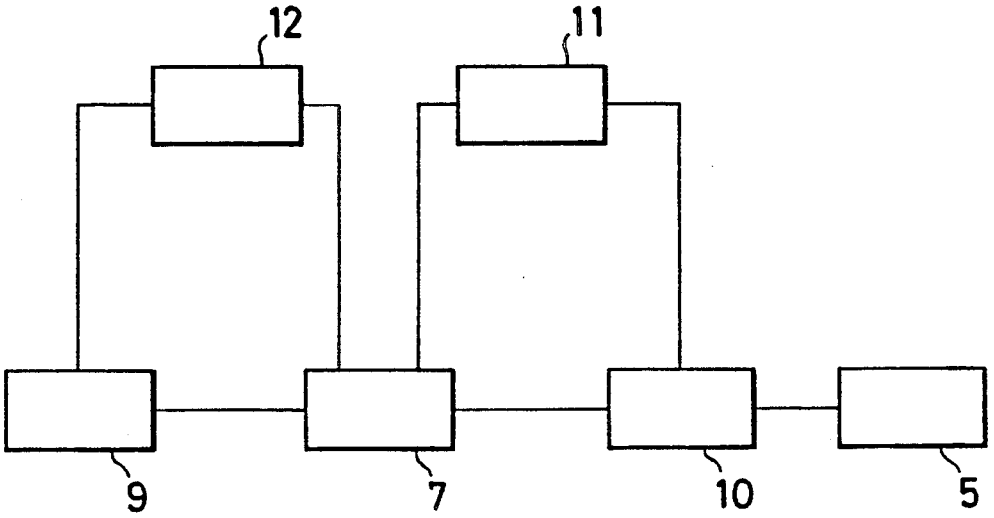
FIG. 2 is a block diagram of a circuit of the embodiment illustrated in FIG. 1.

Further, a roller rotating unit (refer to FIG. 2) comprising a motor 10 is accommodated within the box-like body 2. The motor 10 is connected to the rollers 5. An electric power source including a cell 11 for driving the rollers 5 and an electric power source including another cell 12 for operating the buzzer 9 are accommodated in the cell accommodating recess 6. As shown in FIG. 2, the motor 10, the cell 11 and the switch 7 cooperate with each other to form a circuit, while the buzzer 9, the cell 12 and the switch 7 cooperate with each other to form another circuit. By doing so, it is possible to prevent noises due to the roller rotating unit from being generated in a buzzer sound.

The closure frame 3 has its rear side which is mounted to the rear side of the box-like body 2 for angular movement thereabout. A plurality of rollers 5' are rotatably mounted to one side of the closure frame 3 in facing relation to the rollers 5 on the box-like body 2. A pair of press strips 13 and 13 are provided respectively on rear faces of respective both sides of the closure frame 3. A soft opaque sheet 14 such as white vinyl chloride or the like has its both sides which are clamped between the rear face of the closure frame 3 and the pair of press strips 13 and 13 so as to be stretched upon the inner periphery of the closure frame 3. A pair of knobs 19 and 19 are mounted to the front side of the closure frame 3.

If necessary, the upper surface of the soft opaque sheet 14 is provided a layer of paraffin. Moreover, a rectangular carbon-paper press frame 15 is mounted to the rear face of the closure frame 3. The carbon-paper press frame 15 has its both sides whose respective proximal ends are mounted to the closure frame 3. A pair of engaging projections 17 and 17 are provided respectively at the forward ends of both sides of the carbon-paper press frame 15. The pair of engaging projections 17 and 17 are detachably engageable respectively with the pair of press strips 13 and 13. A carbon paper 16 is detachably clamped between the carbon-paper press frame 15 and the closure frame 3 in such a manner that the carbon paper 16 is superimposed upon the rear face of the opaque sheet 14.

Figure 3:
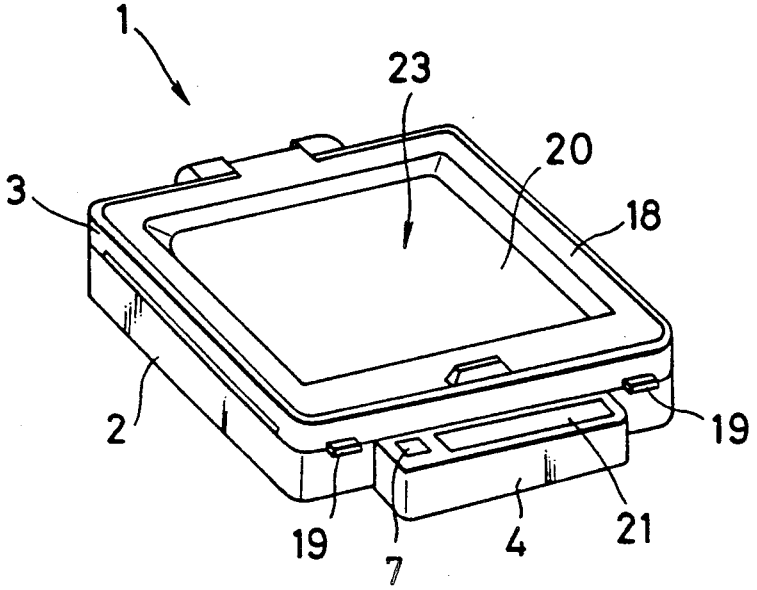
FIG. 3 is a perspective view of the copying apparatus illustrated in FIG. 1, the closure frame being moved to its closed position.

An upper closure frame 18 is mounted to the upper face of the closure frame 3 such that the upper closure frame 18 is movable angularly about a rear side of the upper closure frame 18. A transparent soft sheet 20 such as vinyl chloride or the like in which a fluorescent agent is contained is stretched upon the rear face of the upper closure frame 18 so as to cover the inner periphery of the latter. As shown in FIG. 3, when the upper closure frame 18 is moved to its closed position, the transparent soft sheet 20 and the opaque sheet 14 are superimposed upon each other to form a copy sheet 23.

Figure 4:
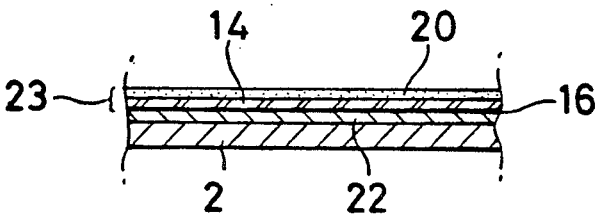
FIG. 4 is an enlarged cross-sectional view of a principal portion of the copying apparatus illustrated in FIG. 1.

The using method of the copying apparatus 1 constructed as above will next be described below. First, the closure frame 3 is moved to its open position to cause a paper 22 to rest on the box-like body 2 such that one side of the paper 22 rests on the upper faces of the respective rollers 5. The carbon-paper press frame 15 is moved to its open position to clamp the carbon paper 16 between the closure frame 3 and the carbon-paper press frame 15. The pair of engaging projections 17 and 17 on the carbon-paper press frame 15 are then engaged respectively with the pair of press strips 13 and 13. Subsequently, as shown in FIG. 3, when the upper closure frame 18 and the closure frame 3 are moved to their respective closed positions, the upper face of the box-like body 2, the paper 22, the carbon paper 16, the opaque sheet 14 and the transparent soft sheet 20 are superimposed upon each other in the mentioned order from the below as shown in FIG. 4. The one side of the paper 22 is clamped between the pairs of rollers 5 and 5'. Subsequently, an entering instrument having a sharp forward end (not shown) writes characters or letters or pictures onto the upper face of the transparent synthetic resinous sheet 20. By doing so, the transparent soft sheet 20 is into close contact with the opaque sheet 14 at locations at which an urging force is applied to the transparent soft sheet 20 by the forward end of the entering instrument. A light is reflected at the locations so that the characters or the pictures are embossed, as being written, onto the upper face of the transparent soft sheet 20. Simultaneously, the same characters or pictures are copied also onto the paper 22.

Lastly, when the switch 7 is depressed, the cell 11 and the motor 10, and the cell 12 and the buzzer 9 are connected to each other simultaneously. The rollers 5 are rotated while emitting the sound. The paper 22 is fed out to the outside of the copying apparatus 1.

In the case where it is desired to erase the characters or the pictures which have been entered onto the copying sheet 23, the upper closure frame 18 is moved upwardly to its open position, and the transparent soft sheet 20 and the opaque sheet 14 are torn off or separated from each other.

In connection with the above, normally or usually, the cell accommodating recess 6 is covered by a closure (not shown) so as to be flush with the upper face of the box-like body 2.

What is claimed is:

1. A copying apparatus in which a transparent soft sheet is mounted to an upper face of an opaque sheet so as to be in contact with and out of contact with the latter, said copying apparatus comprising a closure frame, a box-like body having a smooth upper face, said closure frame being mounted to said box-like body in an openable and closable manner, a carbon-paper press frame superimposed upon a rear face of said closure frame in an openable and closable manner, roller means mounted to one side of said box-like body and to one side of said closure frame in facing relation, wherein said opaque sheet is made of a soft material and is stretched upon said closure frame, wherein said roller means is connected to a roller rotating unit, and wherein said roller rotating unit is connected to an electric power source through a switch.

2. The copying apparatus according to claim 1, wherein said opaque sheet is white in color.

3. The copying apparatus according to claim 1, wherein said closure frame is mounted to said box-like body for angular movement toward and away therefrom.

4. The copying apparatus according to claim 1, wherein said closure frame has a press frame which is engageable with a pair of engaging projections provided on said carbon-paper press frame.

5. The copying apparatus according to claim 1, wherein said transparent soft sheet is stretched upon an upper closure frame which is mounted to said closure frame in an openable and closable manner.

6. The copying apparatus according to claim 1, wherein said electric power source includes at least one cell which is accommodated within a projection on said box-like body.

7. The copying apparatus according to claim 1, wherein said switch is provided on a projection on said box-like body.

8. The copying apparatus according to claim 1, wherein said box-like body has a projection which is formed therein with an entering-instrument accommodating recess.

9. The copying apparatus according to claim 1, wherein said buzzer is incorporated in a location below a bottom face of said entering-instrument accommodating recess.

10. The copying apparatus according to claim 1, wherein said roller rotating unit and said buzzer are connected respectively to a pair of electric power sources which are separate from each other.

11. The copying apparatus according to claim 1, further comprising a sound emitting means connected to said electric power source.

12. The copying apparatus according to claim 11, wherein said sound emitting means is a buzzer.

13. The copying apparatus according to claim 1, comprising a pair of roller means.

* * * * *